US008886077B2

(12) United States Patent
Nishino et al.

(10) Patent No.: US 8,886,077 B2
(45) Date of Patent: Nov. 11, 2014

(54) IMAGE FORMING APPARATUS

(75) Inventors: Yoshiro Nishino, Toride (JP); Kenji Suzuki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 96 days.

(21) Appl. No.: 13/338,576

(22) Filed: Dec. 28, 2011

(65) Prior Publication Data

US 2012/0183314 A1 Jul. 19, 2012

(30) Foreign Application Priority Data

Jan. 13, 2011 (JP) ..... 2011-004916

(51) Int. Cl.
*G03G 21/20* (2006.01)
*G03G 15/00* (2006.01)

(52) U.S. Cl.
CPC ..... *G03G 21/206* (2013.01); *G03G 21/203* (2013.01)
USPC ..... 399/92; 399/94; 399/97; 399/110

(58) Field of Classification Search
USPC ..... 399/44, 92, 93, 97; 361/676, 688, 695
See application file for complete search history.

(56) References Cited

U.S. PATENT DOCUMENTS

| | | | | |
|---|---|---|---|---|
| 4,727,385 | A | 2/1988 | Nishikawa et al. | |
| 5,708,938 | A | 1/1998 | Takeuchi et al. | |
| 6,065,299 | A * | 5/2000 | Chen | 62/277 |
| 2004/0013442 | A1* | 1/2004 | Suzuki et al. | 399/92 |
| 2005/0138939 | A1* | 6/2005 | Spanger | 62/150 |
| 2006/0117771 | A1* | 6/2006 | Fujimori et al. | 62/176.1 |
| 2010/0050756 | A1* | 3/2010 | Stewart | 73/114.55 |
| 2012/0051778 | A1 | 3/2012 | Nishino et al. | |

FOREIGN PATENT DOCUMENTS

| | | | |
|---|---|---|---|
| EP | 1657603 | A1 | 5/2006 |
| JP | 58-217982 | A | 12/1983 |
| JP | 2006-276215 | A | 10/2006 |

OTHER PUBLICATIONS

Chinese Office Action dated Jan. 27, 2014 in related Chinese Patent Application No. 201210009691.2 (with English translation).

* cited by examiner

*Primary Examiner* — David Gray
*Assistant Examiner* — Sevan A Aydin
(74) *Attorney, Agent, or Firm* — Fitzpatrick, Cella, Harper, & Scinto

(57) ABSTRACT

An image forming apparatus includes an image forming unit configured to form a toner image on a recording material, a fixing unit configured to fix the toner image on the recording material by heat, a cooling air generating unit configured to generate a cooling air, and an air supplying unit configured to supply the cooling air toward the image forming unit. In addition, a primary water absorbing portion is configured to absorb water generated by the cooling air generating unit, and a secondary water absorbing portion is disposed at a position lower than the primary water absorbing portion in a gravitational direction and configured to absorb the water supplied through the primary water absorbing portion. An air blowing unit blows air warmed by the fixing unit toward the primary and secondary water absorbing portions to evaporate the water absorbed in the first and secondary water absorbing portions.

19 Claims, 8 Drawing Sheets

(a)

(b)

IMAGE FORMING APPARATUS

FIELD OF THE INVENTION AND RELATED ART

The present invention relates to an image forming apparatus such as a printer, a copying machine, a facsimile machine or a multi-function machine of these machines, electrostatic recording type, or the like. Particularly, the present invention relates to a structure including a cooling device for cooling an inside of a casing in which an image forming portion is provided.

In the image forming apparatus, such as the copying machine or the printer, of the electrophotographic type, a toner image formed by an image forming portion is transferred onto a recording material and then is subjected to application of heat and pressure by a fixing device, thus being fixed on the recording material.

The heat generated by the fixing device is not only applied to the recording material but also is dissipated in the inside of the casing of the image forming apparatus, and therefore, the temperature of the image forming portion is raised by this heat dissipation. Particularly, in the case of a structure in which a two-component developer containing a toner and a carrier, it is known that frictional heat is generated by friction between the developer and a sleeve or a screw in a developing device constituting the image forming portion and thus the structure causes self temperature rise. Accordingly, the temperature in the developing device is more liable to rise in combination with the above-described heat dissipation from the fixing device. Thus, when the temperature in the developing device rises, it is known that the developer may be caked, or deterioration of the developer is considerably promoted.

In view of this, the image forming apparatus equipped with a means for cooling the inside of the casing has been conventionally known. As the cooling device, generally, in many cases, a constitution in which a fan is used to rake the ambient air, thus cooling the inside of the casing is employed. On the other hand, in recent years, there is also a structure in which a cooling device using vaporization as in a refrigerator or air conditioner or a cooling device using the Peltier effect is used to generate the air having a temperature lower than that of the (ambient) air outside the casing, thus reducing the temperature in the casing. For example, a cooler provided on a side surface of the main assembly of the copying machine to supply a cool air into the copying machine is devised (Japanese Laid-open Patent Application (JP-A) Sho 58-217982.

In the case where, as the cooling device for cooling the inside of the casing, the structure having the constitution, as described in JP-A Sho 58-217982, in which the cooling air having the temperature lower than that of the air outside the casing is generated is used, water is always generated during the generation of the cooling air and therefore drainage treatment is problematic. As a treating method of this drainage, it would be considered that the drainage is stored in a tank (container) or the like and then is periodically discarded or that pipework for the drainage is made as in the air conditioner and then the drainage is run into the outdoors or a sewer.

However, in the case where the drainage is stored in the tank or the like, the cooling device is provided in the neighborhood of the surface of the floor in many cases and therefore even when the tank is provided, the capacity cannot be ensured, so that there is a need to drain out the water in the tank frequently. Further, in the case where the pipework for treating the drainage is made, disposition work is on a large scale, so that a disposition cost becomes mammoth. In addition, due to convenience of routing of a drain pipe, a disposition space is also limited and therefore a slight movement of the device cannot be effected.

SUMMARY OF THE INVENTION

In view of the above circumstances, a principal object of the present invention is to provide an image forming apparatus capable of easily treating drainage generated by providing a cooling device with no need to store water in a tank and frequently drain off the water and with no need to effect pipework.

According to an aspect of the present invention, there is provided an image forming apparatus comprising: a main assembly for forming an image; a casing in which the main assembly is provided; a cooling device for cooling an inside of the casing by generating cooling air lower in temperature than air outside the casing; a liquid evaporator for receiving water generated during generation of the cooling air and for evaporating the water by circulation of air; and a heat exhausting device for supplying the air warmed by the main assembly to the liquid evaporator.

These and other objects, features and advantages of the present invention will become more apparent upon a consideration of the following description of the preferred embodiments of the present invention taken in conjunction with the accompanying drawings.

Figure 4:
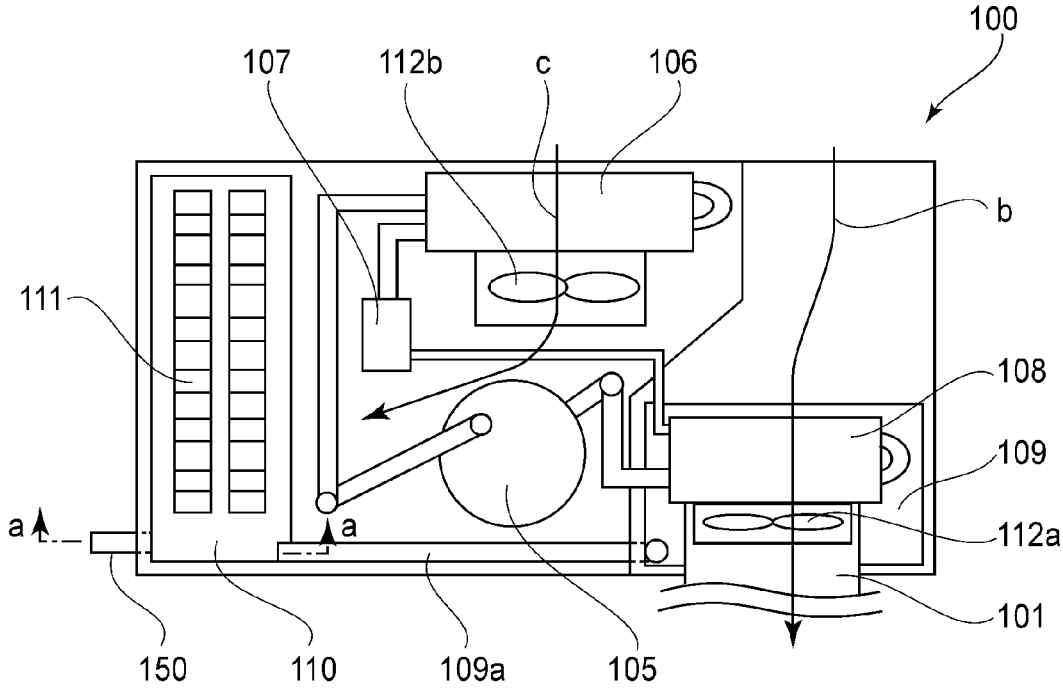
Figure 4:
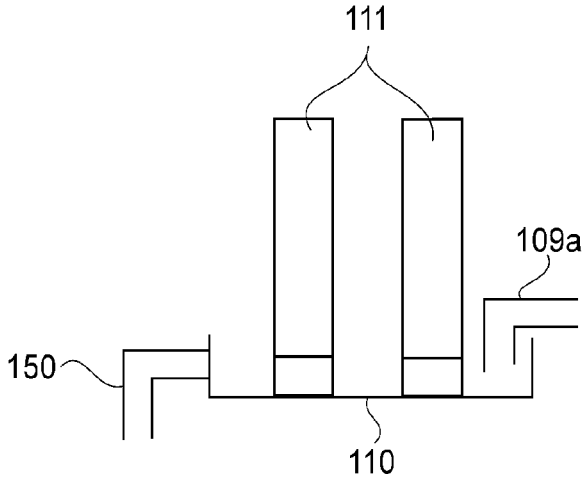

Part (a) of FIG. 4 is a schematic plan view of a cooling device, and (b) of FIG. 4 is an enlarged sectional view taken along a-a line indicated in (a) of FIG. 4.

Figure 5:
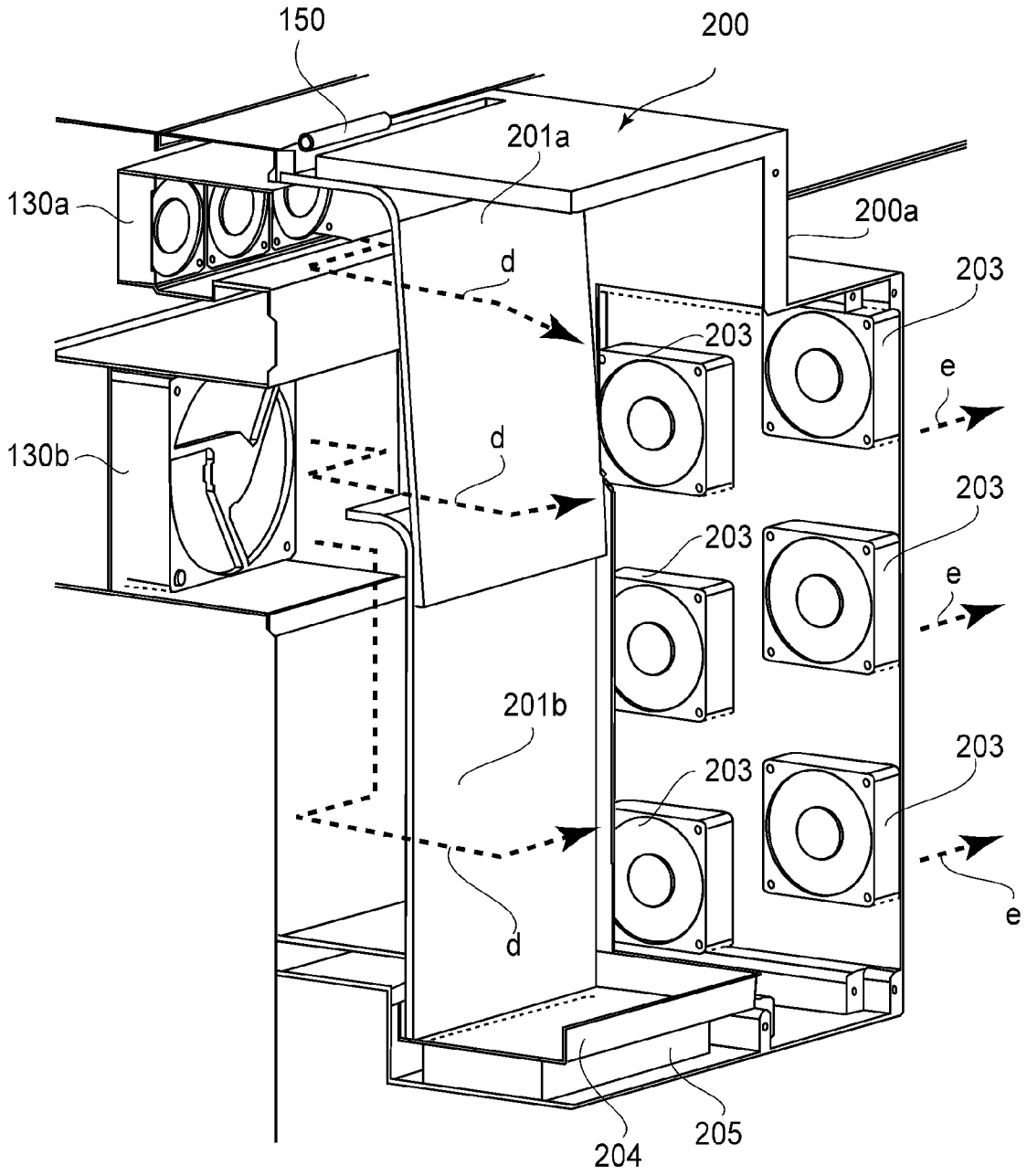

FIG. 5 is a schematic perspective view of a drainage treatment portion in the First Embodiment.

Figure 6:
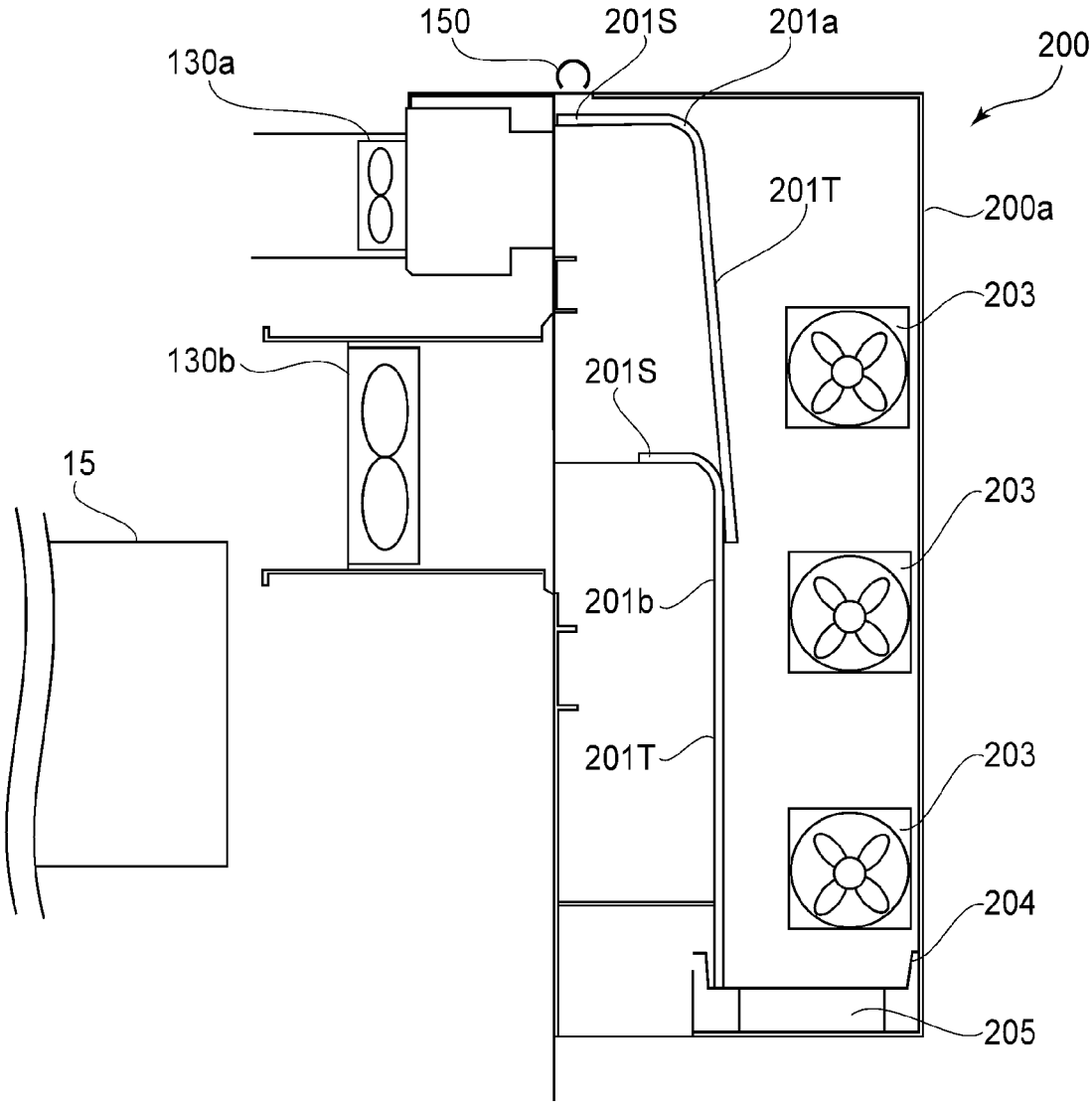

FIG. 6 is a schematic sectional view of the drainage treatment portion in First Embodiment.

Figure 7:
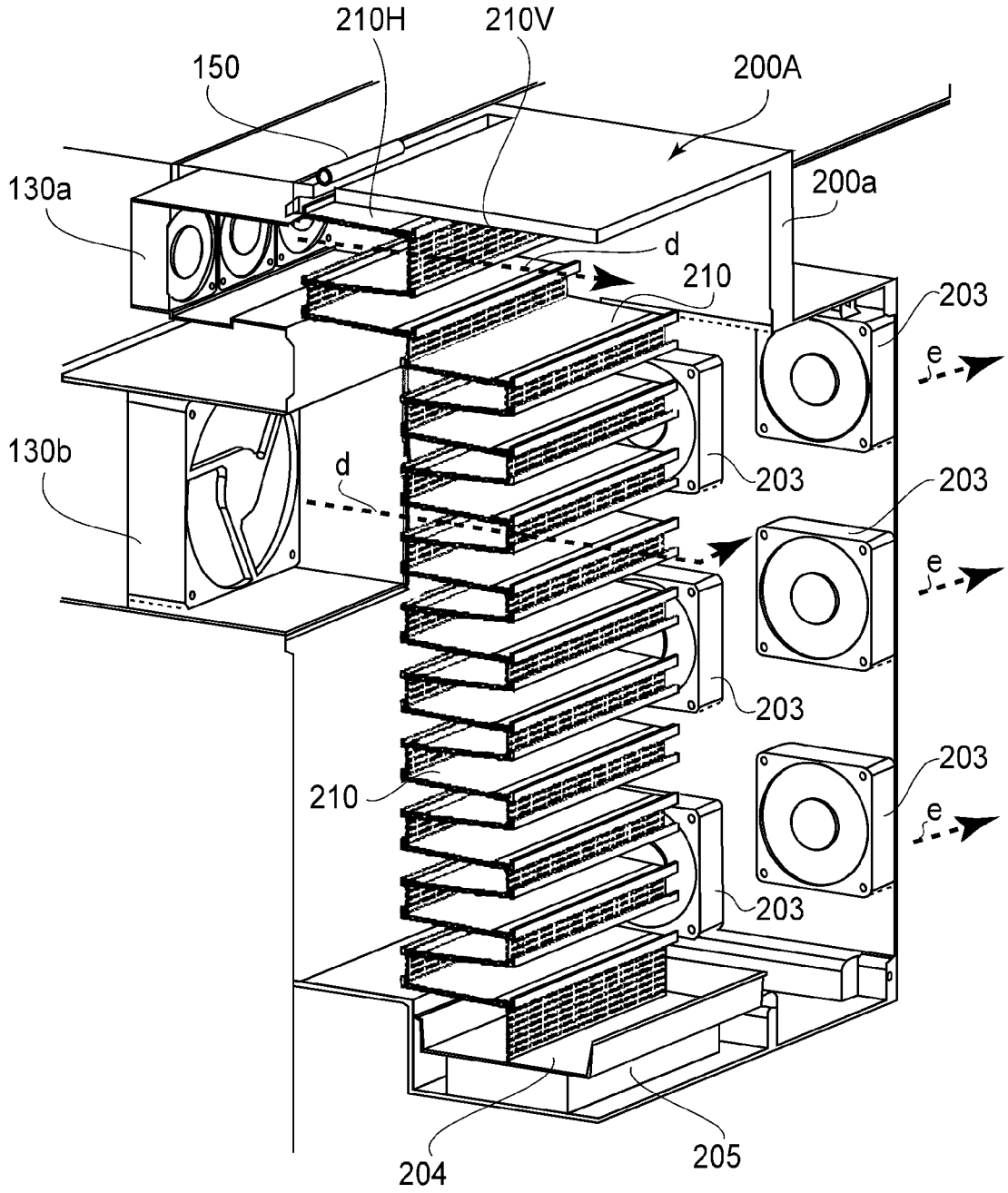

FIG. 7 is a schematic perspective view of a drainage treatment portion in a Second Embodiment of the present invention.

Figure 8:
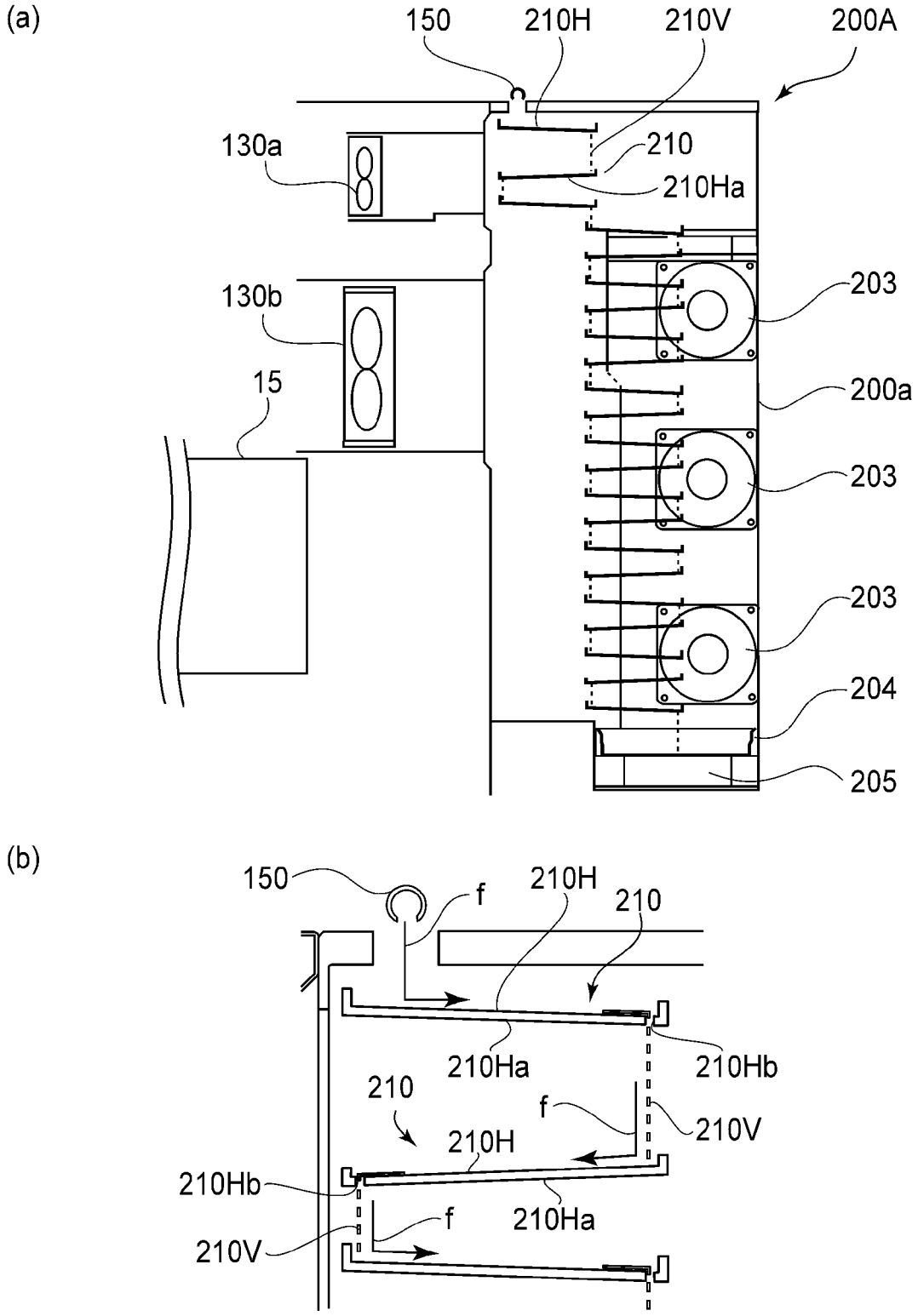

Part (a) of FIG. 8 is a schematic sectional view of the drainage treatment portion in Second Embodiment, and (b) of FIG. 8 is an enlarged view of an upper right portion in (a) of FIG. 8.

DESCRIPTION OF THE PREFERRED EMBODIMENTS

<First Embodiment>

The first embodiment of the present invention will be described with reference to FIG. 1 to FIG. 6. In this embodiment, an image forming apparatus A includes an image forming apparatus main assembly B, a cooling device 100 and a drainage treatment portion 200. First, the image forming apparatus main assembly B in this embodiment will be described with reference to FIGS. 1 to 3.

[Image Forming Apparatus]

Figure 1:
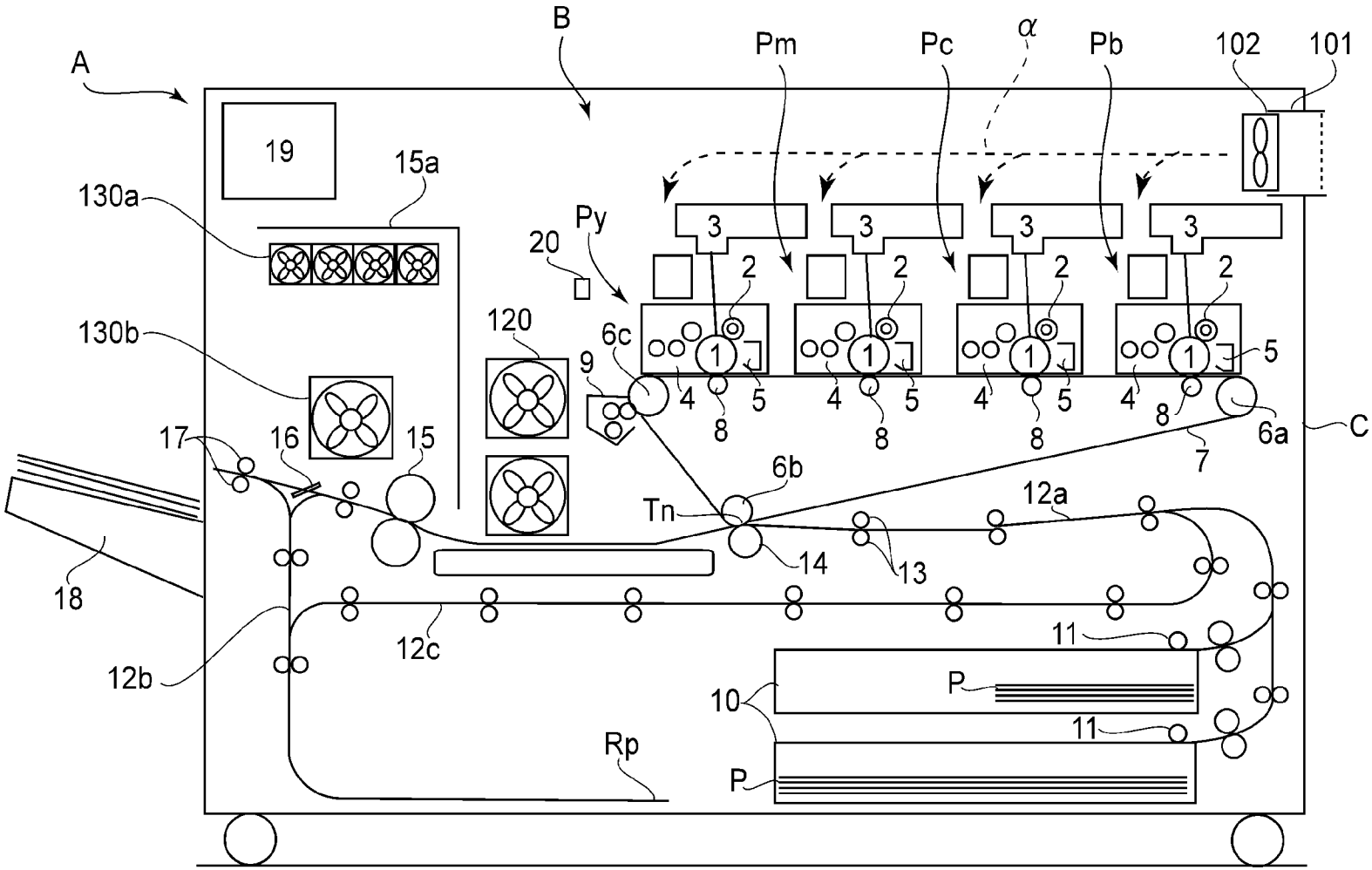
FIG. 1 is a schematic illustration of an image forming apparatus according to a First Embodiment of the present invention.

The image forming apparatus A shown in FIG. 1 is a full-color laser printer of an electrophotographic type. The image forming apparatus main assembly B constituting the image forming apparatus A forms four color toner image different in color by first, second, third and fourth image forming portions Py, Pm, Pc and Pb juxtaposed in a casing C. Then, via an intermediary transfer belt 7, these four color toner images are transferred onto a recording material and are heat-fixed on the recording material by a fixing device 15. That is, the image forming apparatus main assembly B forms the image on the recording material through respective processes of charging, exposure, development, transfer and fixing. A control portion 19 as a control means (controller) includes CPU and memories such as ROM and RAM. Further, when image information outputted from an external device (not shown) such as a host computer or from a scanner is inputted, the control portion 19 successively actuates the image forming portions Py, Pm, Pc and Pb in accordance with an image formation control sequence stored in the memory.

At each of the image forming portions Py, Pm, Pc and Pb, a photosensitive drum 1 as an image bearing member is rotated in an arrow direction at a predetermined peripheral speed (process speed). Further, an intermediary transfer belt 7 extended around a driving roller 6*a*, a follower roller 6*b* and a tension roller 6*c*, so as to force the photosensitive drums 1 of the image forming portions Py, Pm, Pc and Pb is rotated by the driving roller 6*a* in an arrow direction at a peripheral speed corresponding to the peripheral speed of the rotation of the photosensitive drum 1.

Then, in the image forming portion Py for yellow as a first color, the outer peripheral surface (surface) of the photosensitive drum 1 is charged uniformly by a charger 2 to a predetermined polarity and potential. Next, the charged surface of the photosensitive drum 1 is exposed to and scanned with laser light generated on the basis of the image information inputted from the external device by an exposure device 3. As a result, an electrostatic latent image depending on the image information is formed on the charged surface of the photosensitive drum 1. The (electrostatic) latent image is developed with a yellow toner (developer) by a developing device 4, so that a yellow toner image (developer image) is formed on the surface of the photosensitive drum 1.

Similar steps of charging, exposure and development are carried out in the image forming portion Pm for magenta as a second color, the image forming portion Pc for cyan as a third color and the image forming portion Pb for black as a fourth color.

The toner images of respective colors formed on the surfaces of the photosensitive drums 1 in the image forming portion P are transferred superimposedly onto the outer peripheral surface of the intermediary transfer belt 7 by primary transfer rollers (transfer members) 8 disposed opposed to the photosensitive drums 1 via the intermediary transfer belt 7. As a result, a full-color toner image is formed on the surface of the intermediary transfer belt 7. Transfer residual toner remaining on the surface of the photosensitive drum 1 after the toner image transfer is removed by a drum cleaner 5 and the photosensitive drum 1 is then subjected to subsequent image formation.

On the other hand, a recording material P is fed out of a sheet feeding cassette 10 by a delivery roller 11 and is fed to registration rollers 13 along a feeding path 12*a*. Then, the recording material P is fed to a secondary transfer nip Tn which is between the intermediary transfer belt 7 and a secondary transfer roller 14, by the registration rollers 13. Then, the recording material P is nip-conveyed in the secondary transfer nip Tn and the toner image on the surface of the intermediary transfer belt 7 is transferred onto the recording material P in this conveyance process by the secondary transfer roller 14. The transfer residual toner remaining on the surface of the intermediary transfer belt 7 after the toner image transfer is removed and the intermediary transfer belt 7 is subjected to subsequent image formation.

The recording material P on which the unfixed toner image is carried is introduced into a nip of the fixing device 15 with an image carrying surface upward. Then, the recording material P is nipped and conveyed in the nip of the fixing device 15, so that the toner image is heat-fixed on the recording material P. In the case where the image is formed only on one side of the recording material P, the recording material P discharged from the fixing device 15 is guided by a switching member 16 to a discharging roller 1 through which the recording material P is discharged onto a discharging tray 18 provided on a side surface of the casing C. In the case where the images are formed on both sides of the recording material P, the recording material P discharged from the fixing device 15 is guided by switching member 16 to a reverse feeding path 12*b* provided below.

In the reverse feeding path 12*b*, when the trailing edge of the recording material P reaches a reversion point Rp, the recording material P is switch-backed, so that it is fed to a feeding path 12*c* for the both-sided print with the image carrying surface upward. The recording material P is fed out of the feeding path 12*c* to the registration rollers 13 along the feeding path 12*a*. In this state, the image carrying surface is directed downward. This recording material P is fed to the secondary transfer nip Tn by the registration rollers 13, thus being nip-conveyed in the secondary transfer nip Tn. Then, during this conveyance process, the toner image on the intermediary transfer belt 7 is transferred onto the recording material P by the secondary transfer roller 14, and is heat-fixed on the recording material S by the fixing device 15. The recording material P discharged from the fixing device 15 is guided to the discharging roller 17 by the switching member 16 and is discharged onto the discharging tray 18 by the discharging roller 17.

Figure 2:
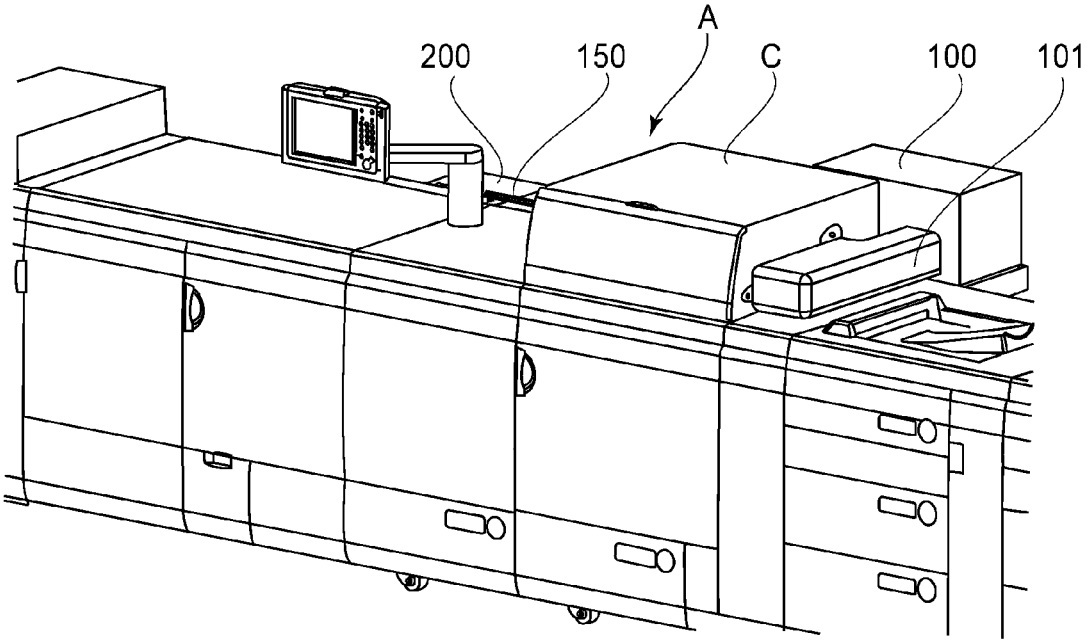
FIG. 2 is a perspective view of a disposition (installation) state of the image forming apparatus as seen from a front side.
Figure 3:
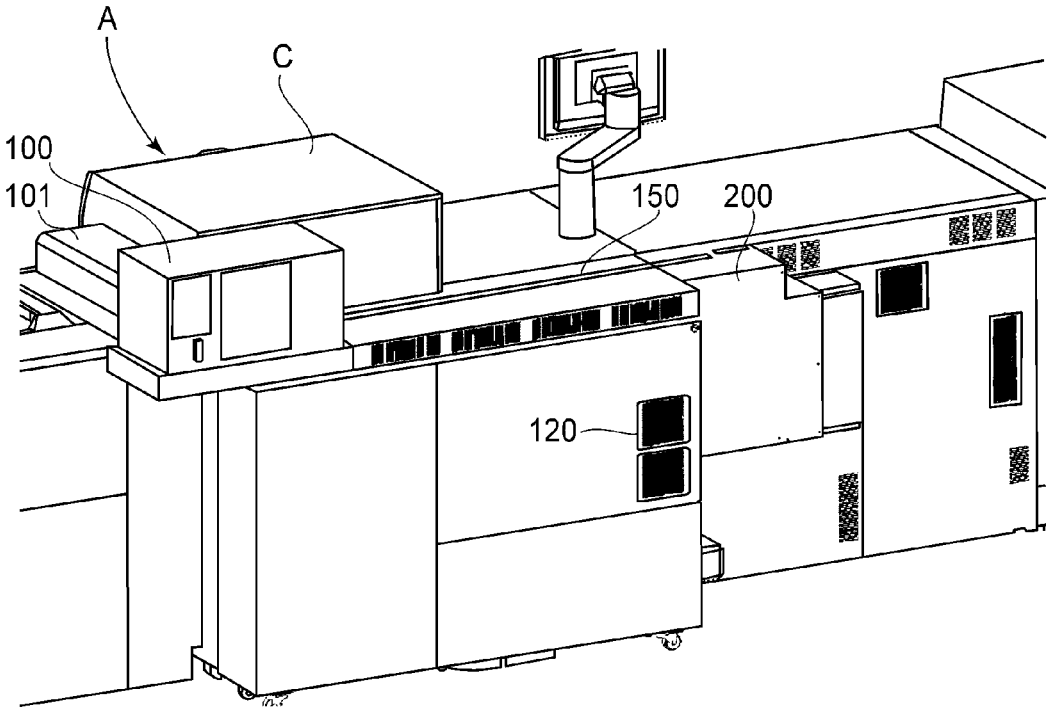
FIG. 3 is a perspective view of the disposition state as seen from a rear side.

FIGS. 2 and 3 show an outer appearance of the image forming apparatus. When the image forming apparatus A is viewed from a front surface side, at an upper-right rear portion, the cooling device 100 is provided. Further, behind the fixing device 15, the drainage treatment portion 200 for treating water drained off from the cooling device 100 is provided.

The cooling device 100 is disposed above the respective image forming portions Py, Pm, Pc and Pb with respect to the direction of gravitation and generates cooling air (cool air) having the temperature lower than that of the ambient air outside the casing C. The generated cool air is smoothly sent from the cooling device 100 into the casing C via a connection duct 101 by an air supply fan 102 as an air supply means provided at a joint portion between the connection duct 101 and the casing C. The air supply fan 102 is disposed at the image forming portion Pb side remote from the fixing device 15. The cool air sent into the casing C passes through gaps between the exposure devices 3*y*, 3*m*, 3*c* and 3*b* as indicated by an arrow a of a broken line in FIG. 1 to extend to the periphery of the photosensitive drum 1 and the developing device 4 of each of the image forming portions Py, Pm, Pc and Pb, thus cooling these portions.

On the other hand, an exhaust fan 120 as an exhaust means is disposed on the image forming portion Py side remote from the air supply fan 102 to exhaust the air in the casing C to the outside of the casing C. Thus, in this embodiment, the air supply fan 102 is disposed at the remotest position from the fixing device 15 which is a maximum heat generating source in the image forming apparatus main assembly, and the exhaust fan 120 is disposed in the neighborhood of the fixing device 15. Further, second exhaust fans 130*a* and 130*b* which are principally used for exhausting the air in the neighborhood of the fixing device 15 and are also used as a heat exhausting means are separately and independently provided in the neighborhood of the fixing device 15. The air exhausted by the second exhaust fans 130*a* and 130*b* is exhausted to the outside via the drainage treatment portion 200 as described later.

Further, at the periphery of the fixing device 15 and the second exhaust fans 130*a* and 130*b*, a shielding wall 15*a* is provided so as to cover the side of the air supply fan 120 and the exhaust fan 120. Thus, by providing the shielding wall 15*a* while regulating the disposition positions of the respective fans, the cool air supplied from the air supply fan 102 is not readily sent to the fixing device 15 and at the same time the heat of the fixing device 15 is not readily transmitted to the image forming portions and their peripheral portions.

In this embodiment, the cooling device 100 is, as described above, disposed above the image forming portions (Py, Pm, Pc, Pd) of the image forming apparatus A with respect to the direction of gravitation and therefore the cool air is efficiently and smoothly sent to the image forming portions and their peripheral portions by using the gravitation. Therefore, in combination with less transmission of the heat of the fixing device 15 to the image forming portions and their peripheral portions, it is possible to efficiently prevent temperature at the image forming portions and their peripheral portions.

[Cooling Device]

Next, the cooling device 100 will be described with reference to FIG. 4. In this embodiment, the cooling device 100 uses a constitution of heat of evaporation. The cooling device 100 comprises mainly, as shown in (a) of FIG. 4, a compressor 105, a condenser 106, an evaporator 108 and a drier 107.

As a mechanism of the cooling device 100, first, the coolant is compressed by the compressor 105 into a high temperature and high pressure state. The high temperature and high pressure coolant dissipates heat in the condenser 106, so that the temperature of the coolant is lowered and the coolant is liquefied. At a portion of the condenser 106, heat is generated. Then, from the liquefied coolant, impurities such as water (moisture) content and contaminant are removed by the drier 107, so that the coolant is sent to the evaporator 108. In this evaporator 108, the coolant is reduced in pressure and expands. That is, in a low pressure and low temperature state, the coolant evaporates, and at this time it deprives the heat (of evaporation) of the neighborhood thereof. Thus, the cool air is just generated.

The air (ambient air) outside the casing C is, as indicated by an arrow b, drawn in by the fan 112*a* and passes through the evaporator 108 to be cooled to low temperature. Then, the cooled air (cool air) passes through the connection duct 101 and is supplied into the casing C by the fan 102 described above.

On the other hand, when the ambient air passes through the evaporator 108 in the cooling device 100, the ambient air is cooled, so that condensation occurs at the surface of the evaporator 108. This condensed water content is dropped onto a drain pan (tray) 109 disposed at a lower portion of the evaporator 108 and is sent to an evaporation pan 110 through a pipe 109*a*. On the evaporation pan 110, as shown in (b) of FIG. 4, on evaporation sheet 111 is provided. The evaporation sheet 111 is constituted by a nonwoven fabric or a foam member and sucks up and holds the water (content). To this evaporation sheet 111, by the fan 112*b*, as indicated by an arrow c, the air (warm air) which passes through the condenser 106 and then passes through the neighborhood of the compressor 105 is sent. As a result, by using the heat generated from the condenser 106 and the compressor 105, a part of the water held by the evaporation sheet 111 is evaporated. Here, the water which cannot be evaporated passes through a drainage pipe 150 to be sent to the drainage treatment portion 200.

[Drainage Treatment Portion]

Next, the drainage treatment portion 200 will be described with reference to FIGS. 5 and 6. The drainage treatment portion 200 includes sheet members 201*a* and 201*b* formed with the nonwoven fabric as a liquid evaporation means, second exhaust fans 130*a* and 130*b* as a heat exhaust means, and a third exhaust fan 203 as an exhaust means.

The sheet members 201*a* and 201*b* retain the water generated during the generation of the cooling (cool) air exhausted from the cooling device 100 and evaporates the retained water by circulation of the air. In this embodiment, the sheet members 201*a* and 201*b* are prepared by forming a water (moisture) absorbing nonwoven fabric into sheet shape and then by bending the sheet in an L-like shape. Then, a short portion 201S having a short length of each of the sheet members 201*a* and 201*b* is disposed in the substantially horizontal direction and a long portion 201T having a long length hangs down from an end of the short portion 201S.

The sheet members 201*a* and 201*b* are disposed in plurality in the direction of gravitation. In this embodiment, two sheet members are vertically arranged so that a lower end portion of the upper sheet member 201*a* overlaps with an upper end portion of the lower sheet member 201*b*. That is, the upper and lower sheet members 201*a* and 201*b* overlap with each other at a part thereof. Incidentally, in an example illustrated in FIGS. 5 and 6, the upper sheet member 201*a* and the lower sheet member 201*b* have different shapes but may also have the same shape. Further, the number of the sheet members to be disposed may also be three or more or one. Further, below the lower sheet member 201*b* with respect to the direction of gravitation, a drainage receiving tray 204 as a receiving member for starting the water which is not evaporated by and is dropped from the sheet members 201*a* and 201*b* is disposed.

Such sheet members 201*a* and 201*b* are provided outside (behind) the second exhaust fans 130*a* and 130*b* as the heat exhaust means of the fixing device 15. These second exhaust fans 130*a* and 130*b* are also arranged and provided in the direction of gravitation. Further, the upper second exhaust fan 130*a* is provided in a plurality of exhaust fan portions (four in the example illustrated in FIGS. 5 and 6 as shown in FIG. 1) and these exhaust fan portions are arranged and provided in the horizontal direction. On the other hand, the lower second exhaust fan 130*b* is a single exhaust fan having a large size than that of each of the fan portions of the upper second exhaust fan 130*a*.

The thus disposed second exhaust fans 130*a* and 130*b* airy the air warmed by the image forming apparatus main assembly B to the sheet members 201*a* and 201*b*. Particularly, in this embodiment, the second exhaust fans 130*a* and 130*b* are, as described above, disposed in the neighborhood of the fixing device 15. Therefore, the second exhaust fans 130*a* and 130*b* airy the air principally warmed by the fixing device 15 to the sheet members 201 and 201*b*.

Further, with respect to the sheet members 201*a* and 201*b*, at an opposite side of the second exhaust fans 130*a* and 130*b*, a plurality of the third fans 203 are disposed. That is, the drainage treatment portion 200 is provided with the sheet members 201*a* and 201*b* disposed so as to cover the second exhaust fans 130*a* and 130*b* provided at the rear portions of the casing C and is provided with a second casing 200*a* so as to cover the sheet members 201*a* and 201*b*. Further, at a part of the second casing 200*a*, the third exhaust fans 203 are disposed downstream of the sheet members 201*a* and 201*b* with respect to an air flow direction.

In this embodiment, the third exhaust fans 203 are provided in six in total by being arranged in two parallel rows each including three fans arranged in the direction of gravitation. Further, the disposition position of these third exhaust fans 203 is a side wall of the second casing 200*a* perpendicular to an air feeding direction of the second exhaust fans 130*a* and 130*b*. Such third exhaust fans 203 exhaust the air passing through the sheet members 201*a* and 201*b* to the outside of the casing C.

In the case of the thus constituted embodiment, as described above, the drainage sent from the drainage pipe 150 drops on the short portion 201S of the upper sheet member 201*a*. The dropped water moves in the sheet member 201*a* by the capillary action and then slowly moves in the long portion 201T vertically extending in the direction of gravitation along the drop direction. Further, the water which is not evaporated in the sheet member 201*a* is sent to the lower sheet member 201*b* via the above-described casing (overlapping) portion.

In this case, the air exhausted from the second exhaust fans 130*a* and 130*b* is, as indicated by arrows d in FIG. 5, blown onto the sheet members 201*a* and 201*b*. Thereafter, by the third exhaust fans 203, as indicated by arrows e in FIG. 5, the air passing through the sheet members 201*a* and 201*b* flows so as to turn to the right. As described above, the air exhausted from the second exhaust fans 130*a* and 130*b* is dried by the high temperature heat of the fixing device 15. Therefore, the high temperature air is supplied to the sheet members 201*a* and 201*b* by the second exhaust fans 130*a* and 130*b* and the third exhaust fans 203 and flows in the neighborhood of the sheet members 201*a* and 201*b*. As a result, the water in the sheet members 201*a* and 201*b* is efficiently evaporated. The air containing the water evaporated from the sheet members 201*a* and 201*b* is exhausted to the outside of the image forming apparatus by the third exhaust fans 203.

Further, in this embodiment, a water amount detecting sensor 205 as a water amount detecting means for detecting an amount of the water stored in the drainage receiving tray 204 disposed below the lower sheet member 201*b* with respect to the direction of gravitation is provided. This water amount detecting sensor 205 detects the amount of the water stored in the drainage receiving tray 204, e.g., by detecting the weight of the drainage receiving tray 204. As such a water amount detecting sensor, in addition to the weighing structure, e.g., a structure in which the drainage receiving tray 204 is provided with a float. In this structure, the float comes up by an increase of the amount of the stored water and when the float comes up in a predetermined amount, the sensor detects that the water in the predetermined amount is stored. As the water amount detecting sensor 205, that having another structure may also be used.

In either structure, in the case where the water in the predetermined amount is detected by the water amount detecting sensor 205, the control portion 19 lowers the cooling performance of the cooling device 100. For example, the control portion 19 increases a set temperature of the cooling device 100 and widens a driving interval of the cooling device 100. As a result, an air of the drainage from the cooling device 100 is decreased, so that overflow of the water from the drainage receiving tray 204 is prevented.

That is, in this embodiment, as a countermeasure to leakage of the drainage in the event of accident, the drainage receiving tray 204 is provided below the sheet member 201*b* disposed at the lowest portion. Further, the drainage receiving tray 204 is provided with the water amount detecting sensor 205 for preventing the overflow, thus preventing the overflow of the drainage from the drainage receiving tray 204 in the case where the drainage is abruptly increased in amount due to some factor. Specifically, in the case where the water amount detecting sensor 205 detects a full amount (predetermined amount) of the drainage, an instruction to drain off the drainage is provided to an operating portion and at the same time the operation of the cooling device 100 is limited. Incidentally, in the case where the drainage cannot be drained off and the water amount is increased even when the operation of the cooling device 100 is limited, e.g., in the case where the water amount detecting sensor 205 detects a second predetermined amount which is larger than the above-described predetermined amount, the cooling device 100 may also be stopped.

Further, in this embodiment, as shown in FIG. 1, a temperature sensor 20 as a temperature detecting means for detecting the temperature in the casing C is provided. In the case of the example illustrated in FIG. 1, the temperature sensor 20 is disposed in the neighborhood of the image forming portion Py remotest from the air supply fan 102. Further, the control portion 19 lowers productivity of the image forming apparatus main assembly B in the case where a predetermined temperature is detected by the temperature sensor 20. For example, an image forming speed is lowered by widening an interval of image formation. As a result, an amount of heat in the image forming apparatus main assembly B is reduced, so that temperature rise in the casing C can be suppressed.

Particularly, as described above, in the case where the operation of the cooling device 100 is limited, the temperature in the casing C can be increased and therefore in such a case, the temperature sensor 20 detects a predetermined temperature and then the operation of the image forming apparatus main assembly B is limited. In the case where the temperature rises even when the operation of the image forming apparatus main assembly B is limited, a user may also be notified of a massage of that effect by giving a warning or the like.

Incidentally, in this embodiment, the lower sheet member 201*b* extends to the neighborhood of the bottom of the drainage receiving tray 204 and therefore, even in the case where the drainage on the drainage receiving tray 204 is not drained off, the sheet member 201*b* sucks up the water stored in the drainage receiving tray 204. Then, as described above, the air is supplied to the sheet member 201*b* by the second exhaust fans 130*a* and 130*b* to dry the sheet member 201*b*. For this reason, the amount of the water on the drainage receiving tray 204 can be reduced with time.

SPECIFIC EXAMPLE

A specific example in this embodiment will be described. First, as the air supply fan 102, two axial-flow fans each having substantially 120 mm-square shape as seen from the front side are used, and an amount of supply air is about 1-3 $m^3$/min. Further, as the exhaust fan 120, a single axial-flow fan having substantially 120 mm-square shape as seen from the front side is used, and the amount of supply air is about 0.5-1.5 $m^3$/min. Further, as the second exhaust fans 130*a* and 130*b* for exhausting principally the heat of the fixing device 15, two axial-flow fans each having substantially 120 mm-square shape as seen from the front side are used, and the amount of the supply air is about 1-3 $m^3$/min. Further, as the third exhaust fans 203 for exhausting the air in the drainage treatment portion 200, six axial-flow fans each having substantially 60 mm-square shape as seen from the front side are used, and the amount of supply air is about 1.2-3.3 $m^3$/min.

Further, the performance of the cooling device 100 is such that the air outside the casing C is lowered in temperature by about 5-10° C. and then is supplied. For this purpose, the power of the cooling device 100 is about 500 W and the rated power of the compressor is about 150 W, and as the coolant, R134a, improved in operation efficiency, of HFC as an alternative to CFCs (chlorofluorocarbons) is used. Such a cooling device 100 drains off the water in an amount of about 0.3 litter per hour (about 0.3 L/h) in an environment of 27° C. and 70% RH.

Therefore, by the exhaust of the air from the second exhaust fans 130*a* and 130*b*, the drainage may only be required to be evaporated in the amount of 0.3 liter per hour. Here, an exhaust temperature of the air from the second exhaust fans 130*a* and 130*b* is about 60° C., and a flow rate of the air exhausted from the second exhaust fans 130*a* and 130*b* is about 150 $m^3$/h. Further, in the case where the specific gravity of the water is 1.0 g/$cm^3$, the water of 0.3 L (300 $cm^3$) is 300 g. For this reason, the water of 2 g per 1 $m^3$ (300 g/150 $m^3$) of the amount of the air of the second exhaust fans 130*a* and 130*b* is evaporated. The saturated vapor volume at 60° C. is 129.86 g/$m^3$ and therefore 2/129.86=0.015 . . . (about 2%).

From the above, the air exhausted from the second exhaust fans 130*a* and 130*b* passes through the sheet members 201*a* and 201*b* and when the humidity of about 2% is raised, the whole drainage from the cooling device 100 is evaporated in calculation. In other words, when the material and area of the sheet members 201*a* and 201*b* are determined so as to satisfy such a condition, the whole drainage from the cooling device 100 can be evaporated. For this purpose, as the sheet members 201*a* and 201*b*, a 5 mm-thick non-woven fabric which uses, as a starting material, aramid fiber having a standard (official) moisture regain of 5.5% and which is 0.25 g/$cm^3$ in standard density is used. However, the material for the sheet members 201*a* and 201*b* is not limited to such a material but may also be a material formed of, e.g., a foam member so long as the material has properties of high water absorption, high water retention and high humidity retention.

According to this embodiment, the water drained off from the cooling device 100 is retained in the sheet members 201*a* and 201*b* and the air warmed in the image forming apparatus main assembly B is supplied to the sheet members 201*a* and 201*b*, so that the water retained in the sheet members 201*a* and 201*b* can be efficiently evaporated. For this reason, there is no need to frequently store the water in the tank and then drain of the water and is no need to effect pipework, so that the treatment of the drainage generated by providing the cooling device 100 can be effected easily. Particularly, in this embodiment, as the air (the heat to be exhausted) warmed in the image forming apparatus main assembly B, the exhaust heat of the fixing device 15 is principally used and therefore is helpful in recycling of heat.

<Second Embodiment>

Second Embodiment of the present invention will be described with reference to FIGS. 7 and 8. This embodiment is the same as that in First Embodiment except that a structure of a liquid evaporation portion 210*a* as a liquid evaporation means of a drainage treatment portion 200A is different from a corresponding structure in First Embodiment. For this reason, portions similar to those in First Embodiment will be omitted or simplified from description and illustration. In the following, the portion different from that in First Embodiment will be principally described.

In this embodiment, a plurality of liquid evaporation portions 210 each constituted by a tray 210H and a sheet member 210V are disposed along the direction of gravitation. The plurality of trays 210H and the plurality of sheet member 210V are alternately disposed along the direction of gravitation.

Of these members, each of the plurality of trays 210H is disposed slightly inclined from the horizontal direction so as to be directed downward with a distance close to an end of a bottom plate 210Ha. Further, the directions of the inclination of the bottom plates 210Ha are alternately opposite from each other. Further, the respective trays 210H are arranged in the direction of gravitation with a predetermined interval. Further, each bottom plate 210Ha is provided with a cut 210Hb at a lower end portion with respect to the inclination direction, so that the water which reaches the surface of the bottom plate 210Ha flows along the inclination direction of the bottom plate 210Ha and then is dropped from the cut 210Hb.

Further, the sheet member 210V is formed in a sheet shape and is disposed so as to hang from the cut 210Hb of each of the above-described plurality of the trays 210H, and a lower end of the sheet member 210V is close or contacted to an upper end portion of the lower tray 210H with respect to the inclination direction. Further, the sheet member 210V is formed with a mesh-like member so that the drainage is easily evaporated by decreasing a drop speed of the drainage in the sheet member 210V by the capillary action and by increasing the surface area of the sheet member 210V. The mesh used in this case may desirably have the number of meshes of 50-100 per inch and an aperture of about 30-40%. Incidentally, the sheet member 210V may also be the nonwoven fabric or the foam member similarly as in First Embodiment described above.

In this embodiment, as indicated by an arrow f in (b) of FIG. 8, the water dropped from the drainage pipe 150 onto the uppermost tray 210H flows along the inclination direction toward the lower side of the bottom plate 210Ha to reach the cut 210Ha. Then, by the capillary action, the water gradually moves in the sheet member 210V. Further, the water which is no evaporated by the sheet member 210V is sent to the tray 210H present below the sheet member 210V.

In this embodiment, these operations are repeated plural times. Then, to the thus constituted plurality of liquid evaporation portions 210, the high temperature air (the exhaust heat) of the fixing device 15 is blown through the second exhaust fans 130*a* and 130*b*. Thus, the high temperature air passes through the gaps between the trays 210H provided in plurality along the direction of gravitation and then passes through the sheet members 210V as indicated by arrows d in FIG. 7. In this way, by passing the high temperature fixing exhaust heat through the neighborhood of the liquid evaporation portion 210, the water on the liquid evaporation portion 210 is evaporated. The exhaust air which absorbs the water of the liquid evaporation portion 210 is exhausted to the outside of the image forming apparatus by the third exhaust fans 203 as indicated by arrows e.

Incidentally, also in this embodiment, similarly as in First Embodiment, the amount of the water stored in the drainage receiving tray 204 disposed below the lowermost sheet member 210V with respect to the direction of gravitation is detected by the water amount detecting sensor 205. Other structures and actions are the same as those in First Embodiment.

<Other Embodiments>

In the above-described embodiments, the exhaust heat of the fixing device 15 is used but irrespective of this, the water retained by the liquid evaporation means may also be evaporated by using the air warmed in the image forming apparatus main assembly (e.g., the air warmed by the developing device or the various driving motors). For example, the air exhausted by the exhaust fan 120 may also be sent to the drainage treatment portion.

Further, the sheet members 210*a*, 210*b* and 210V is not limited to the nonwoven fabric (including the mesh-like member) and the foam member but may also be those by which the liquid can be evaporated by retaining another liquid and by circulating the air. Further, the sheet members may also be formed by appropriately combining the nonwoven fabric, the foam member or another member. Further, the mesh-like member in Second Embodiment may also be applied to the sheet member in First Embodiment.

Further, in the embodiments described above, the plurality of the second exhaust fans for feeding the air to the liquid evaporation means are disposed along the direction of gravitation but the constitution of these (plural) fans may preferably be such that the amount of the air supplied to the liquid evaporation means present at an upper side with respect to the direction of gravitation becomes smaller. By employing such a constitution, the amount of the air supplied to the upper-side liquid evaporation means with the large water content becomes small and the amount of the air supplied to the lower-side liquid evaporation means with the small water content becomes large. As a result, the water of the upper-side liquid evaporation means with the large water content is blown off without being evaporated, so that it is possible to prevent, e.g., wetting of the outside of the image forming apparatus. On the other hand, even when the air in the large amount is supplied to the lower-side liquid evaporation means which is decreased in water content, the water is evaporated sufficiently.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 004916/2011 filed Jan. 13, 2011, which is hereby incorporated by reference.

What is claimed is:

1. An image forming apparatus comprising:

an image forming unit configured to form a toner image on a recording material;

a fixing unit configured to fix the toner image on the recording material by heat;

a cooling air generating unit configured to generate a cooling air;

an air supplying unit configured to supply the cooling air toward said image forming unit;

primary and secondary water absorbing units configured to absorb water generated by said cooling air generating unit, said primary and secondary water absorbing units being arranged in a gravitational direction so that water which is not evaporated at said primary water absorbing unit is transferred to said secondary water absorbing unit through a first contact portion at which said primary and secondary water absorbing units contact each other; and an air blowing unit configured to blow air warmed by said fixing unit toward said primary and secondary water absorbing units to evaporate the water absorbed in said first and secondary water absorbing units;

wherein said air blowing unit blows more air toward said primary water absorbing unit than said secondary water absorbing unit.

2. An image forming apparatus according to claim 1, wherein said air blowing unit includes a first fan configured to blow the air toward said primary water absorbing unit and a second fan configured to blow the air toward said secondary water absorbing unit.

3. An image forming apparatus according to claim 1, further comprising a fan configured to exhaust the air, which passes through said first and secondary water absorbing units, to outside of said apparatus.

4. An image forming apparatus according to claim 1, further comprising a container disposed at a position lower than said secondary water absorbing unit in the gravitational direction and configured to store the water supplied through said primary and secondary water absorbing units.

5. An image forming apparatus according to claim 4, further comprising:

a detector configured to detect an amount of water stored in said container; and a controller configured to control an operation of said cooling air generating portion.

6. An image forming apparatus according to claim 5, wherein said controller lowers performance of said cooling air generating unit when the amount of the water detected by said detector reaches a predetermined amount.

7. An image forming apparatus according to claim 5, wherein said controller stops the operation of said cooling air generating unit when the amount of the water detected by said detector reaches a predetermined amount.

8. An image forming apparatus according to claim 4, wherein said secondary water absorbing unit extends into said container so as to absorb the water in said container.

9. An image forming apparatus according to claim 8, wherein said secondary water absorbing unit includes at least one of a nonwoven fabric and a foam member.

10. An image forming apparatus according to claim 4, further comprising a tertiary water absorbing unit disposed at a position lower than said secondary water absorbing unit in the gravitational direction and configured to absorb the water supplied through a second contact portion in which said secondary water absorbing unit and said tertiary water absorbing unit contact each other, wherein said tertiary water absorbing unit extends into said container so as to absorb the water in said container.

11. An image forming apparatus according to claim 4, further comprising a plurality of water absorbing units disposed at a position lower than said secondary water absorbing unit in the gravitational direction, wherein one of said water absorbing units extend into said container so as to absorb the water in said container.

12. An image forming apparatus to claim 5, further comprising a temperature detector configured to detect a temperature inside said apparatus, wherein said controller lowers productivity of said apparatus when the temperature detected by said temperature detector reaches a predetermined temperature.

13. An image forming apparatus according to claim 1, wherein said primary water absorbing unit includes at least one of a nonwoven fabric and a foam member, and wherein said secondary water absorbing unit includes at least one of a nonwoven fabric and a foam member.

14. An image forming apparatus according to claim 1, wherein said cooling air generating unit includes a compressor configured to compress a cooling medium and a condenser configured to condense the cooling medium.

15. An image forming apparatus according to claim 1, wherein said air blowing unit blows the air toward said primary water absorbing unit in amount ($m^3$/min) which is smaller than with respect to said secondary water absorbing unit.

16. An image forming apparatus comprising:

an image forming unit configured to form a toner image on a recording material;

a heat generating unit configured to generate heat in an image forming operation;

a cooling air generating unit configured to generate a cooling air;

an air supplying unit configured to supply the cooling air toward said image forming unit;

primary and secondary water absorbing units configured to absorb water generated by said cooling air generating unit, said primary and secondary water absorbing units being arranged in a gravitational direction so that water which is not evaporated at said primary water absorbing unit is transferred to said secondary water absorbing unit through a contact portion at which said primary and secondary water absorbing units contact each other; and an air blowing unit configured to blow air warmed by said heat generating unit toward said primary and secondary water absorbing units to evaporate the water absorbed in said first and secondary water absorbing units;

wherein said air blowing portion blows more air toward said primary water absorbing unit than said secondary water absorbing unit.

17. An image forming apparatus according to claim 16, further comprising a container disposed at a position lower than said secondary water absorbing unit in the gravitational direction and configured to store the water supplied through said primary and secondary water absorbing units.

18. An image forming apparatus according to claim 16, wherein said air blowing unit includes a first fan configured to blow the air toward said primary water absorbing unit and a second fan configured to blow the air toward said secondary water absorbing unit.

19. An image forming apparatus according to claim 16, wherein said air blowing unit blows the air toward said primary water absorbing unit in amount ($m^3$/min) which is smaller than with respect to said secondary water absorbing unit.

* * * * *